US010677469B2

(12) United States Patent
Paller

(10) Patent No.: US 10,677,469 B2
(45) Date of Patent: Jun. 9, 2020

(54) FUEL SUPPLY SYSTEM FOR A GAS BURNER ASSEMBLY

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 201 days.

(21) Appl. No.: 15/787,807

(22) Filed: Oct. 19, 2017

(65) Prior Publication Data

US 2019/0120497 A1 Apr. 25, 2019

(51) Int. Cl.

| | |
|---|---|
| ***F24C 3/12*** | (2006.01) |
| ***F24C 3/08*** | (2006.01) |
| *F23N 5/18* | (2006.01) |

(52) U.S. Cl.

CPC ..... *F24C 3/122* (2013.01); *F24C 3/082* (2013.01); *F24C 3/085* (2013.01); *F24C 3/126* (2013.01); *F23D 2208/00* (2013.01); *F23N 2005/181* (2013.01); *F23N 2005/182* (2013.01)

(58) Field of Classification Search

CPC ..... F24C 3/122; F24C 3/082; F24C 3/085; F24C 3/126; F24C 3/12; F24C 3/08; F23D 14/065; F23D 14/06; F23D 2205/00; F23D 2208/00; F23D 23/00; F23N 5/184; F23N 2037/02; F23N 2005/181; F23N 2005/182; F23K 5/005; F23K 5/00

USPC ..... 431/285, 12, 61; 126/39 R

See application file for complete search history.

(56) References Cited

U.S. PATENT DOCUMENTS

| | | | | | |
|---|---|---|---|---|---|
| 1,984,494 | A | * | 12/1934 | Pinkerton | F24C 5/02 431/238 |
| 2,549,952 | A | * | 4/1951 | Wheelock | F23D 14/045 236/91 R |
| 2,594,430 | A | * | 4/1952 | Hansen | 431/58 |
| 2,799,288 | A | * | 7/1957 | Knight | F23D 14/60 137/98 |
| 2,916,022 | A | * | 12/1959 | Perry | F23N 5/02 122/504 |
| 2,962,094 | A | * | 11/1960 | Wallace | F23N 1/02 431/31 |
| 3,101,897 | A | * | 8/1963 | Vaughn | F23N 1/027 236/1 E |

(Continued)

FOREIGN PATENT DOCUMENTS

| | | | |
|---|---|---|---|
| CN | 1076516 | A | 9/1993 |
| EP | 0887590 | A1 | 12/1998 |

(Continued)

*Primary Examiner* — Steven B McAllister
*Assistant Examiner* — Daniel E. Namay
(74) *Attorney, Agent, or Firm* — Dority & Manning, P.A.

(57) ABSTRACT

A fuel supply system for a gas burner assembly includes a fuel supply, a forced air supply, and an injection assembly positioned proximate the gas burner assembly for providing a flow of combustion air and fuel through an inlet into a fuel chamber. A pressure controlled valve is operably coupled with the fuel supply and the forced air supply, the pressure controlled valve being configured for stopping the flow of fuel when a pressure of the flow of combustion air drops below a predetermined pressure, potentially indicating a malfunction or failure of the forced air supply.

20 Claims, 5 Drawing Sheets

(56) References Cited

U.S. PATENT DOCUMENTS 3,273,520 A * 9/1966 Hottenstine ..... F22B 21/34 110/189
3,481,538 A * 12/1969 Dines ..... F23N 1/025 236/24.5
3,525,325 A 8/1970 Perl
3,578,987 A * 5/1971 De Werth ..... F12N 1/022 1/22
3,935,708 A * 2/1976 Harrewijne ..... F02G 1/043 60/517
3,995,989 A * 12/1976 Epperson ..... F23C 5/10 432/49
4,067,191 A * 1/1978 Gronvall ..... F02G 1/047 60/39.27
4,424,793 A 1/1984 Cooperrider
4,992,040 A * 2/1991 Warren ..... F23N 5/187 431/31
5,209,217 A * 5/1993 Beach ..... F24C 3/126 126/21 R
5,325,842 A * 7/1994 Beach ..... F24C 3/126 126/21 R
5,470,018 A * 11/1995 Smith ..... F23N 1/007 126/116 A
5,509,403 A * 4/1996 Kahlke ..... F24C 3/067 126/39 E
6,234,161 B1 * 5/2001 Levi ..... F24C 15/006 126/19 R
6,322,354 B1 11/2001 Carbone et al.
7,901,205 B2 * 3/2011 Trochou ..... F23D 14/06 126/39 E
8,402,962 B2 * 3/2013 Kim ..... F23D 14/04 126/15 A
8,479,721 B2 7/2013 Graham et al.
8,747,108 B2 * 6/2014 Lona Santoyo ..... F23D 14/06 126/39 B
8,823,714 B1 * 9/2014 Thielvoldt ..... F23N 1/002 126/500
8,845,326 B2 9/2014 Shaffer et al.
8,960,234 B2 2/2015 Cadeau et al.
10,520,186 B2 * 12/2019 Langius ..... F23N 1/025
2004/0163639 A1 * 8/2004 Kijimoto ..... A47J 37/1242 126/374.1
2005/0142511 A1 * 6/2005 Yam ..... F23D 14/06 431/285
2005/0221243 A1 * 10/2005 Najewicz ..... F23D 14/04 431/18
2005/0239006 A1 * 10/2005 Specht ..... F23D 14/04 431/12
2007/0199558 A1 * 8/2007 Kobayashi ..... F24C 3/085 126/39 E
2008/0029077 A1 * 2/2008 Kobayashi ..... A47J 36/34 126/39 R
2011/0143295 A1 * 6/2011 Fowler ..... F23D 14/06 431/285
2014/0060517 A1 * 3/2014 Ren ..... F23D 14/065 126/39 E
2016/0305662 A1 * 10/2016 Nakata ..... F23N 3/002
2017/0108226 A1 * 4/2017 Moon ..... F24C 3/022
2017/0292698 A1 * 10/2017 Langius ..... F23N 1/022
2018/0094809 A1 * 4/2018 Lochschmied ..... F23N 1/025
2018/0156452 A1 * 6/2018 Corti ..... F23N 5/123
2019/0120495 A1 * 4/2019 Paller ..... F24C 3/122
2019/0120496 A1 * 4/2019 Paller ..... F24C 3/122
2019/0120497 A1 * 4/2019 Paller ..... F24C 3/122
2019/0154255 A1 * 5/2019 Negretti ..... F23N 5/203

FOREIGN PATENT DOCUMENTS

JP 52008536 A * 1/1977
JP 2000274670 A * 10/2000 ..... F23N 1/022
JP 2000314510 A 11/2000
KR 100838429 B1 6/2008
WO WO-2011082924 A2 * 7/2011 ..... F23D 14/34

* cited by examiner

FUEL SUPPLY SYSTEM FOR A GAS BURNER ASSEMBLY

FIELD OF THE INVENTION

The present subject matter relates generally to gas burner assemblies, and more particularly, to fuel supply systems for supplying a mixture of fuel and air into gas burner assemblies.

BACKGROUND OF THE INVENTION

Gas burners are commonly used on the cooktops of household gas cooking appliances including e.g., range ovens and cooktop appliances built into cabinetry. For example, gas cooktops traditionally have at least one gas burner positioned at a cooktop surface for use in heating or cooking an object, such as a cooking utensil and its contents. Gas burners generally include an orifice that directs a flow of gaseous fuel into a fuel chamber. Between the orifice and the fuel chamber, the gaseous fuel entrains air, and the gaseous fuel and air mix within the fuel chamber before being ignited and discharged out of the fuel chamber through a plurality of flame ports.

Normally aspirated gas burners rely on the energy available in the form of pressure from the fuel supplied to the gas burner to entrain air for combustion. Because the nominal fuel pressure in households is relatively low, there is a practical limit to the amount of primary air a normally aspirated gas burner can entrain. Introducing a forced air supply (such as a fan or blower) into a gas burner assembly may increase the primary air supplied into the fuel chamber in a relatively quiet and cost effective manner. However, in the event that the forced air supply fails to provide sufficient primary air for any reason, a fuel-rich mixture may be combusted in the fuel chamber, thereby increasing the risk of carbon monoxide exposure. Thus, conventional fuel supply systems including such forced air supply systems often require costly or complicated flow sensors or flow sensing schemes for regulating operation in the event of component failures.

Accordingly, a cooktop appliance including an improved gas burner assembly with improved aeration would be desirable. More particularly, a fuel supply system for a gas burner assembly that increases the flow of primary air without requiring costly and complex fail-safe mechanisms would be particularly beneficial.

BRIEF DESCRIPTION OF THE INVENTION

The present disclosure relates generally to a fuel supply system for a gas burner assembly including a fuel supply, a forced air supply, and an injection assembly positioned proximate the gas burner assembly for providing a flow of combustion air and fuel through an inlet into a fuel chamber. A pressure controlled valve is operably coupled with the fuel supply and the forced air supply, the pressure controlled valve being configured for stopping the flow of fuel when a pressure of the flow of combustion air drops below a predetermined pressure, potentially indicating a malfunction or failure of the forced air supply. Additional aspects and advantages of the invention will be set forth in part in the following description, or may be apparent from the description, or may be learned through practice of the invention.

In one exemplary embodiment, a cooktop appliance includes a top panel and a gas burner assembly positioned at the top panel. The gas burner assembly includes a burner body defining a fuel chamber and a plurality of flame ports, the fuel chamber being in fluid communication with the plurality of flame ports. A fuel supply system includes a fuel supply for providing a flow of fuel through a fuel supply conduit and a forced air supply for providing a flow of combustion air through an air supply conduit. An injection assembly is positioned proximate an inlet of the fuel chamber, the injection assembly being in fluid communication with the fuel supply conduit for receiving the flow of fuel and the air supply conduit for receiving the flow of combustion air. A pressure controlled valve is operably coupled with the fuel supply and the forced air supply, the pressure controlled valve configured for stopping the flow of fuel when a pressure of the flow of combustion air drops below a predetermined pressure.

In another exemplary embodiment, a fuel supply system for a gas burner assembly is provided. The gas burner assembly includes a burner body defining a fuel chamber having an inlet. The fuel supply system includes a fuel supply for providing a flow of fuel through a fuel supply conduit and a forced air supply for providing a flow of combustion air through an air supply conduit. An injection assembly is positioned proximate the inlet of the fuel chamber, the injection assembly being in fluid communication with the fuel supply conduit for receiving the flow of fuel and the air supply conduit for receiving the flow of combustion air. A pressure controlled valve is operably coupled with the fuel supply and the forced air supply, the pressure controlled valve configured for stopping the flow of fuel when a pressure of the flow of combustion air drops below a predetermined pressure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
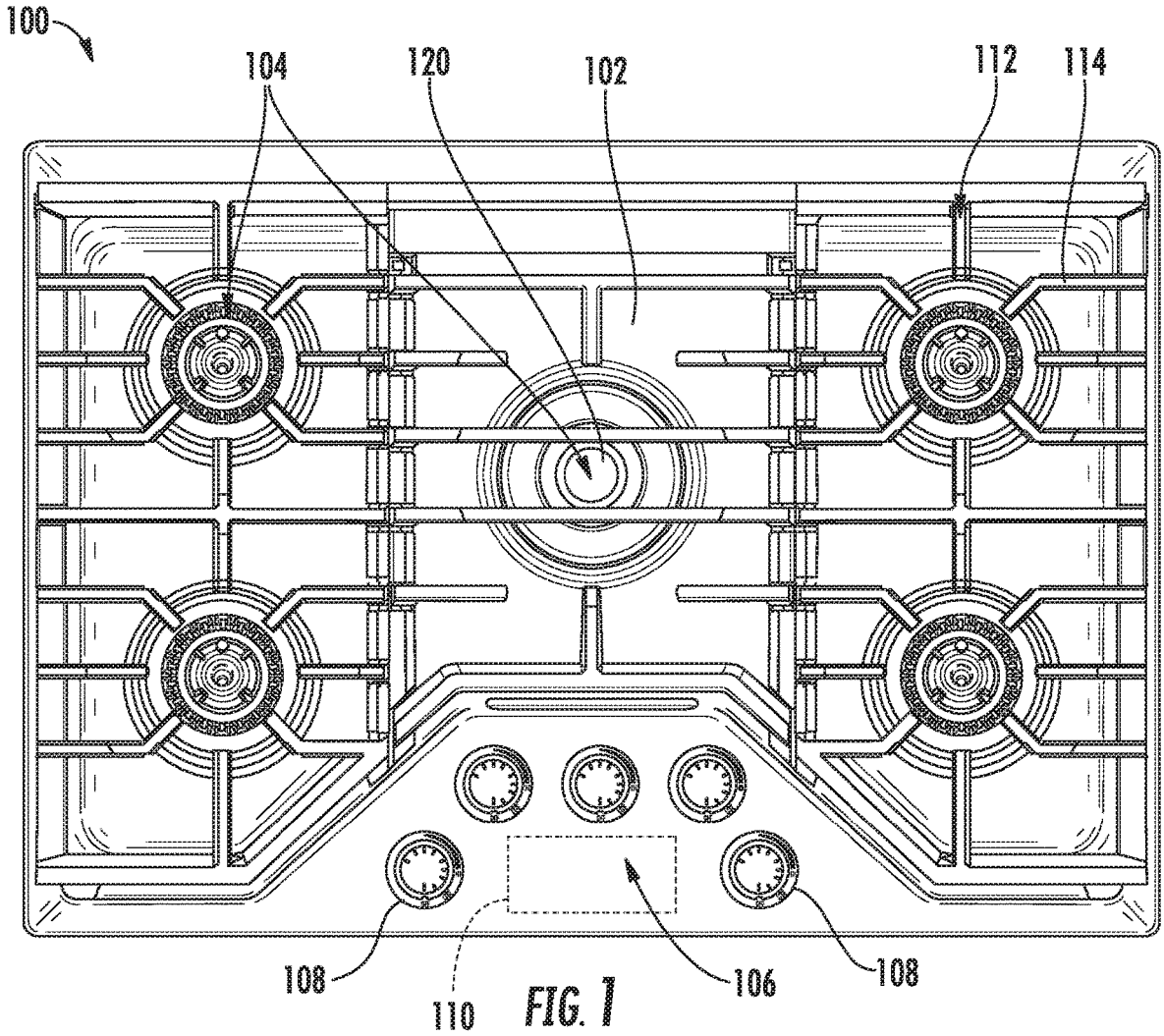
FIG. 1 provides a top view of a cooktop appliance according to an exemplary embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure relates generally to a gas burner assembly for a cooktop appliance 100. Although cooktop appliance 100 is used below for the purpose of explaining the details of the present subject matter, one skilled in the art will appreciate that the present subject matter may apply to any other suitable consumer or commercial appliance. For example, the exemplary gas burner assemblies described below may be used on other types of cooking appliances, such as ranges or oven appliances. Cooktop appliance 100 is used in the discussion below only for the purpose of explanation, and such use is not intended to limit the scope of the present disclosure in any manner.

FIG. 1 illustrates an exemplary embodiment of a cooktop appliance 100 of the present disclosure. Cooktop appliance 100 may be, e.g., fitted integrally with a surface of a kitchen counter, may be configured as a slide-in cooktop unit, or may be a part of a free-standing range cooking appliance. Cooktop appliance 100 includes a top panel 102 that includes one or more heating sources, such as heating elements 104 for use in, e.g., heating or cooking. Top panel 102, as used herein, refers to any upper surface of cooktop appliance 100 on which utensils may be heated and therefore food cooked. In general, top panel 102 may be constructed of any suitably rigid and heat resistant material capable of supporting heating elements 104, cooking utensils, and/or other components of cooktop appliance 100. By way of example, top panel 102 may be constructed of enameled steel, stainless steel, glass, ceramics, and combinations thereof.

According to the illustrated exemplary embodiment, a user interface panel or control panel 106 is located within convenient reach of a user of cooktop appliance 100. For this exemplary embodiment, control panel 106 includes control knobs 108 that are each associated with one of heating elements 104. Control knobs 108 allow the user to activate each heating element 104 and regulate the amount of heat input each heating element 104 provides to a cooking utensil located thereon, as described in more detail below. Although cooktop appliance 100 is illustrated as including control knobs 108 for controlling heating elements 104, it should be understood that control knobs 108 and the configuration of cooktop appliance 100 shown in FIG. 1 is provided by way of example only. More specifically, control panel 106 may include various input components, such as one or more of a variety of touch-type controls, electrical, mechanical or electro-mechanical input devices including rotary dials, push buttons, and touch pads.

According to the illustrated embodiment, control knobs 108 are located within control panel 106 of cooktop appliance 100. However, it should be appreciated that this location is used only for the purpose of explanation, and that other locations and configurations of control panel 106 and control knobs 108 are possible and within the scope of the present subject matter. Indeed, according to alternative embodiments, control knobs 108 may instead be located directly on top panel 102 or elsewhere on cooktop appliance 100, e.g., on a backsplash, front bezel, or any other suitable surface of cooktop appliance 100. Control panel 106 may also be provided with one or more graphical display devices, such as a digital or analog display device designed to provide operational feedback to a user.

Operation of cooktop appliance 100 is controlled by electromechanical switches or by a controller or processing device 110 (FIG. 1) that is operatively coupled to control panel 106 for user manipulation, e.g., to control the operation of heating elements 104. In response to user manipulation of control panel 106, controller 110 operates the various components of cooktop appliance 100 to execute selected instructions, commands, or other features.

Controller 110 may include a memory and microprocessor, such as a general or special purpose microprocessor operable to execute programming instructions or micro-control code associated with appliance operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 110 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 106 and other components of cooktop appliance 100 may be in communication with controller 110 via one or more signal lines or shared communication busses.

According to the illustrated embodiment, cooktop appliance 100 is a gas cooktop and heating elements 104 are gas burners, such as a gas burner assembly 120 described below. As illustrated, heating elements 104 are positioned within top panel 102 and have various sizes, as shown in FIG. 1, so as to provide for the receipt of cooking utensils (i.e., pots, pans, etc.) of various sizes and configurations and to provide different heat inputs for such cooking utensils. In addition, cooktop appliance 100 may include one or more grates 112 configured to support a cooking utensil, such as a pot, pan, etc. In general, grates 112 include a plurality of elongated members 114, e.g., formed of cast metal, such as cast iron. The cooking utensil may be placed on the elongated members 114 of each grate 112 such that the cooking utensil rests on an upper surface of elongated members 114 during the cooking process. Heating elements 104 are positioned underneath the various grates 112 such that heating elements 104 provide thermal energy to cooking utensils above top panel 102 by combustion of fuel below the cooking utensils.

Figure 2:
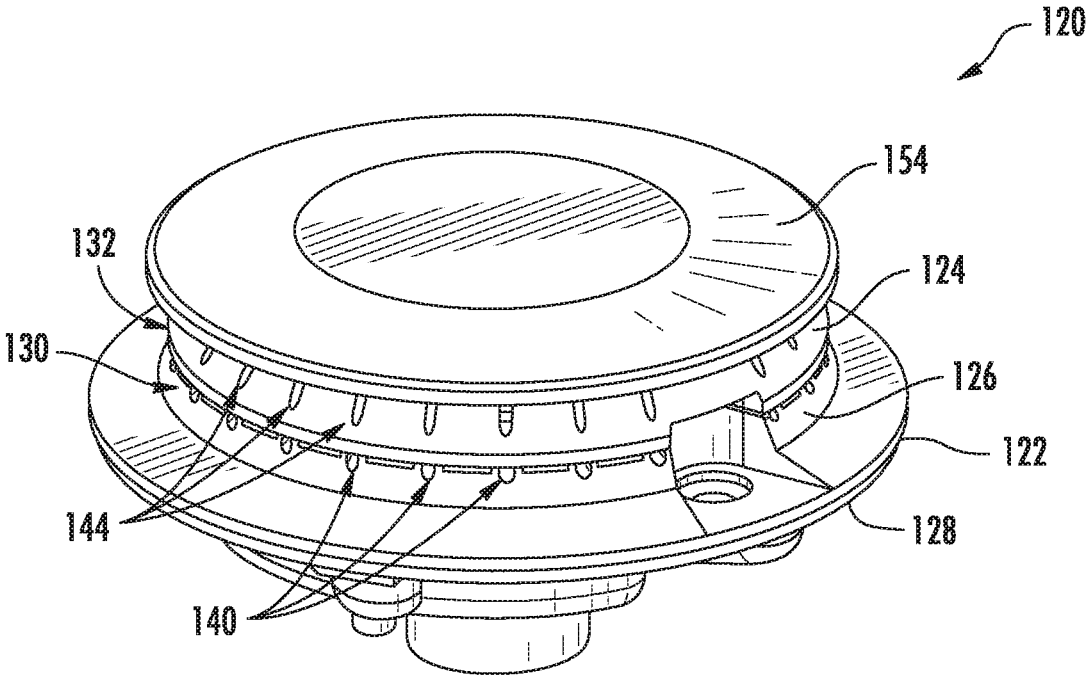
FIG. 2 provides a perspective view of a gas burner assembly of the exemplary cooktop appliance of FIG. 1 according to an exemplary embodiment of the present subject matter.
Figure 3:
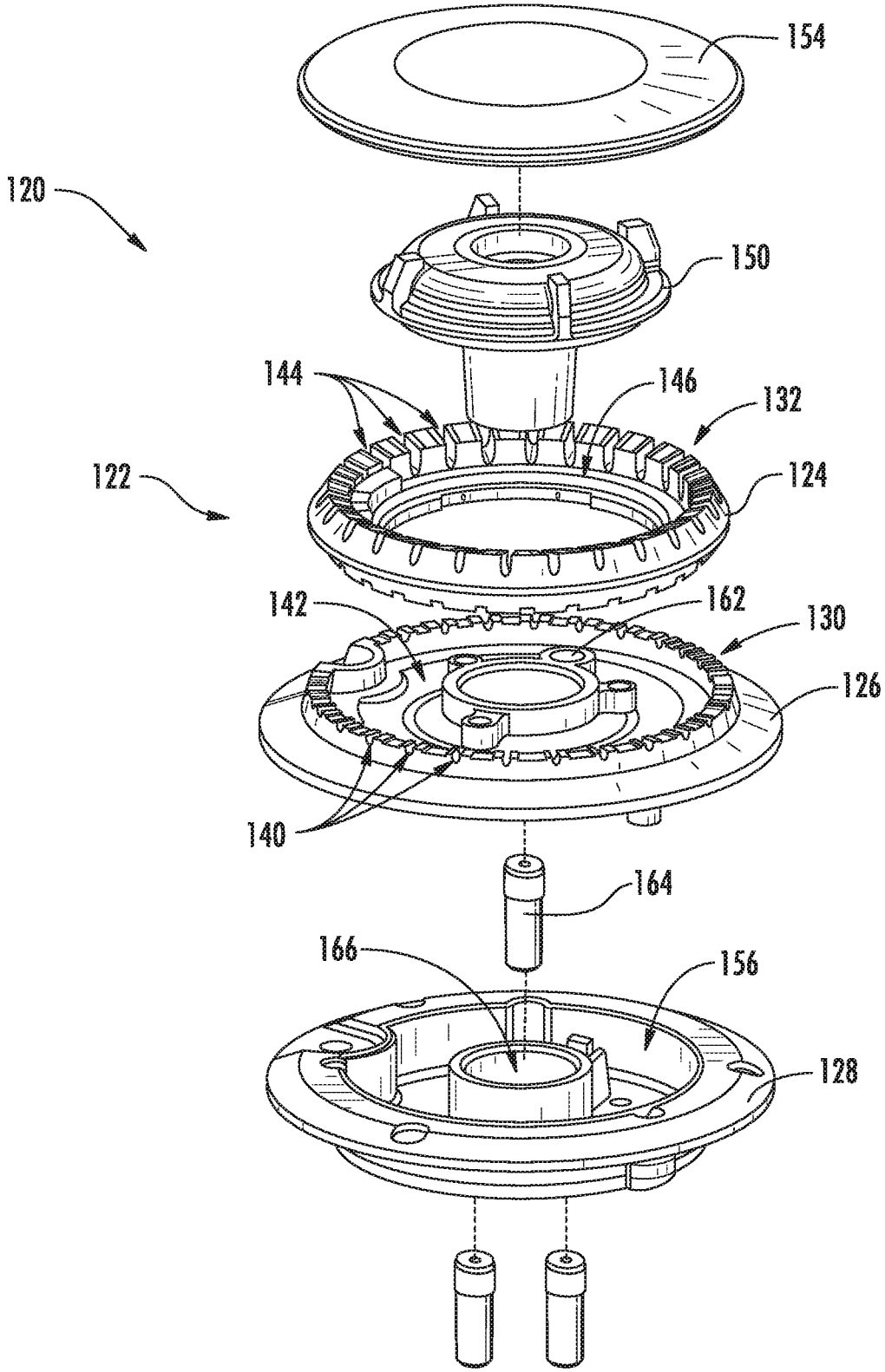
FIG. 3 provides an exploded perspective view of the exemplary gas burner assembly of FIG. 2.
Figure 4:
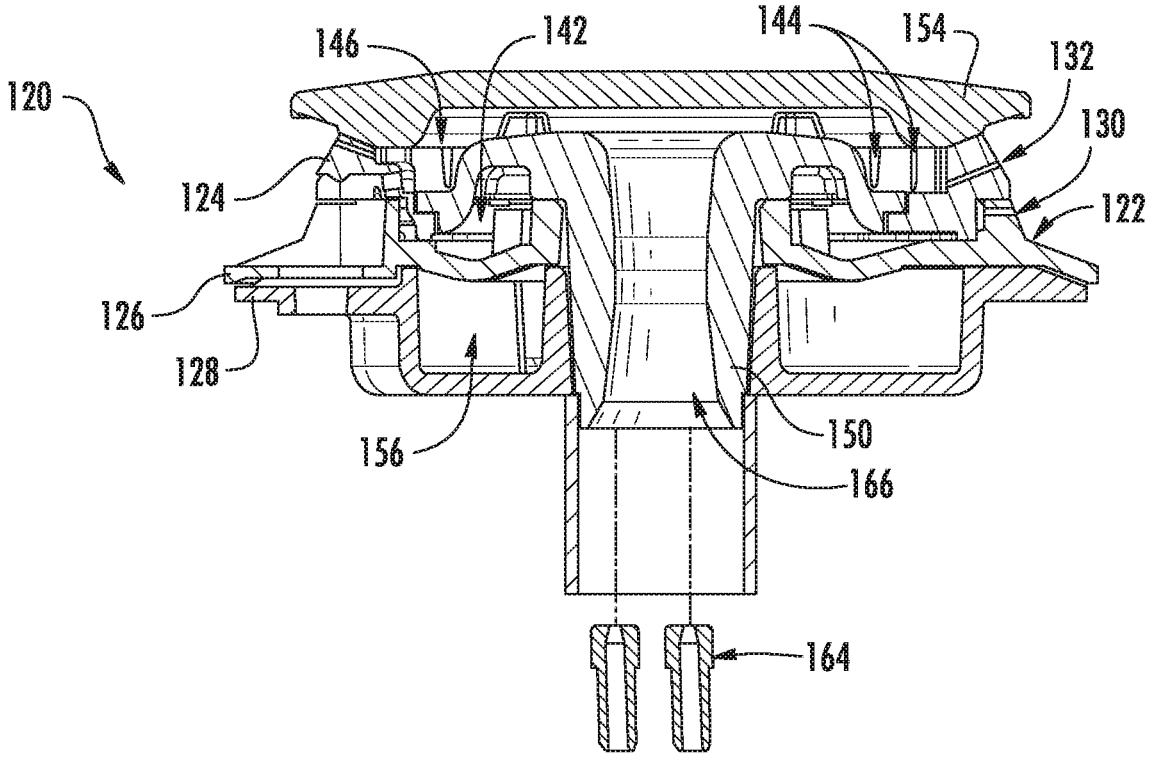
FIG. 4 provides a cross sectional view of the exemplary gas burner assembly of FIG. 2.
Figure 5:
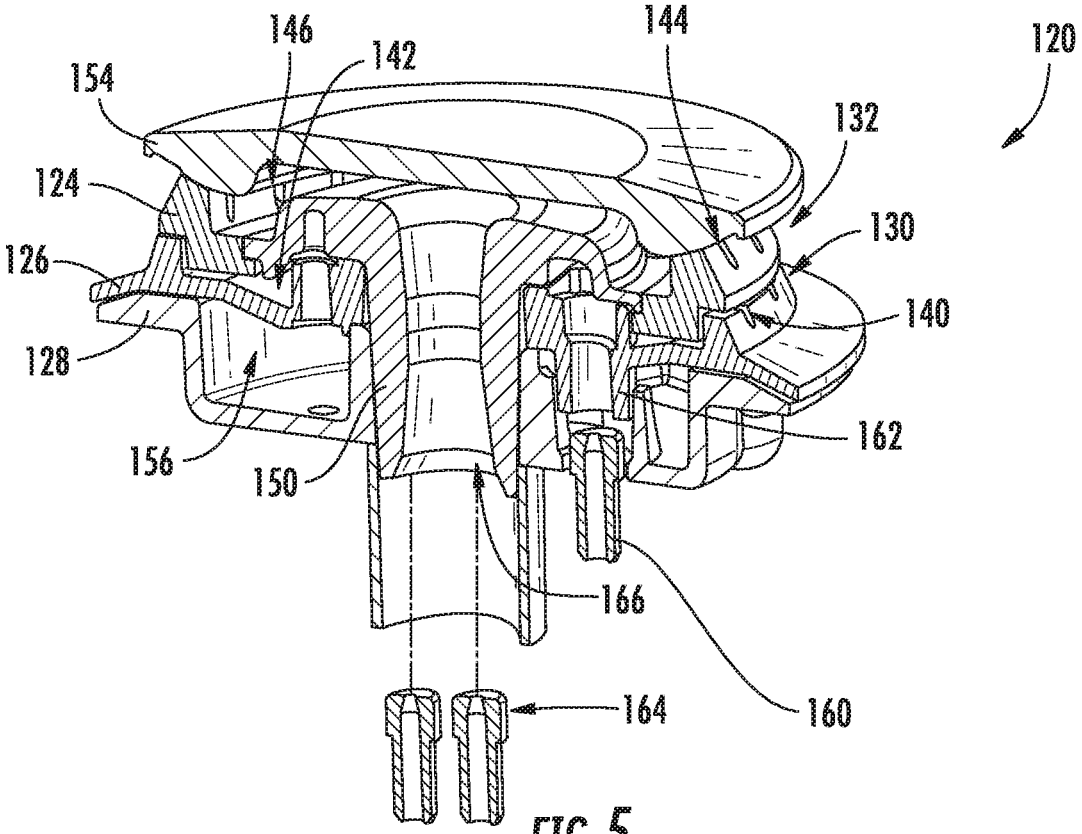
FIG. 5 provides another cross sectional view of the exemplary gas burner assembly of FIG. 2.

FIG. 2 is a perspective view of gas burner assembly 120. FIG. 3 is an exploded view of gas burner assembly 120. FIGS. 4 and 5 are section views of gas burner assembly 120. As an example, gas burner assembly 120 may be used in cooktop appliance 100 (FIG. 1) as one of heating elements 104. However, it will be understood that, while described in greater detail below in the context of cooktop appliance 100, gas burner assembly 120 may be used in or with any suitable appliance in alternative example embodiments.

As may be seen in FIGS. 2 through 5, gas burner assembly 120 includes one or more burner bodies 122, which may include for example, a first burner body 124, a second burner body 126, and a third burner body 128. Burner bodies 122 generally define a first burner ring or stage 130 (e.g., a primary burner) and a second burner ring or stage 132 (e.g., a boost burner). More specifically, first burner stage 130 generally includes a first plurality of flame ports 140 and a first fuel chamber 142 which are defined by first burner body 124 and second burner body 126. Similarly, second burner stage 132 generally includes a second plurality of flame ports 144 and a second fuel chamber 146 which are defined at least in part by first burner body 124.

Gas burner assembly 120 may also include an air duct 150 and a cap 154. First plurality of flame ports 140 may be defined on second burner body 126, e.g., at a circular outer wall of second burner body 126. Similarly, second plurality of flame ports 144 may be defined on first burner body 124, e.g., at a circular outer wall of first burner body 124. Second fuel chamber 146 may be defined by inner surfaces of cap 154, air duct 150, and first burner body 124. First fuel chamber 142 may be defined by inner surfaces of air duct 150, first burner body 124, and second burner body 126. First fuel chamber 142 is separate or independent from second fuel chamber 146 within gas burner assembly 120. Thus, first fuel chamber 142 is not in flow communication with second fuel chamber 146 within gas burner assembly 120. In addition, an air chamber 156 may be defined by second burner body 126 and third burner body 128.

As may be seen in FIGS. 2 through 4, first plurality of flame ports 140 may be positioned concentric with second plurality of flame ports 144. Further, first plurality of flame ports 140 (and first burner stage 130) may be positioned below second plurality of flame ports 144 (and second burner stage 132). Such positioning of first burner stage 130 relative to second burner stage 132 may improve combustion of gaseous fuel when both stages 130, 132 are ignited. For example, flames at first burner stage 130 may assist with lighting gaseous fuel at second burner stage 132 due to the position of first burner stage 130 below second burner stage 132.

According to the exemplary illustrated embodiment, first burner stage 130 is a normally aspirated burner that relies on the energy available in the form of pressure from the fuel supplied to the gas burner to entrain air for combustion. In this regard, for example, as best shown in FIGS. 3 and 5 a first orifice 160 is positioned at, e.g., directly below and/or concentric with, a Venturi inlet passage 162 on second burner body 126. Venturi inlet passage 162 is in fluid communication with first fuel chamber 142. Thus, gaseous fuel from first orifice 160 may flow into first fuel chamber 142 through Venturi inlet passage 162. From first fuel chamber 142, the mixture of gaseous fuel and air may flow through and be combusted at first plurality of flame ports 140. Thus, first plurality of flame ports 140 are in fluid communication with first fuel chamber 142 such that the mixture of gaseous fuel and air within first fuel chamber 142 is flowable through first plurality of flame ports 140. Venturi inlet passage 162 assists with naturally aspirating first burner stage 130. For example, Venturi inlet passage 162 may increase a speed and/or decrease a pressure of gaseous fuel flowing from first orifice 160 such that Venturi inlet passage 162 entrains air from air chamber 156 into Venturi inlet passage 162.

Similarly, for example, as best shown in FIGS. 3 through 5, an injection assembly 164 is positioned at, e.g., directly below and/or concentric with, a second stage inlet passage 166 defined by third burner body 128. Second stage inlet passage 166 is in fluid communication with second fuel chamber 146 such that gaseous fuel and combustion air from injection assembly 164 may flow into second fuel chamber 146 through second stage inlet passage 166. From second fuel chamber 146, the mixture of gaseous fuel and air may flow through and be combusted at second plurality of flame ports 144. Thus, second plurality of flame ports 144 are in fluid communication with second fuel chamber 146 such that the mixture of gaseous fuel and air within second fuel chamber 146 is flowable through second plurality of flame ports 144. Second stage inlet passage 166 may define any suitable shape or profile, e.g., similar to Venturi inlet passage 162, to assist with naturally aspirating second burner stage 132. An injection assembly 164 will be described in further detail below according to an exemplary embodiment of the present subject matter.

Figure 6:
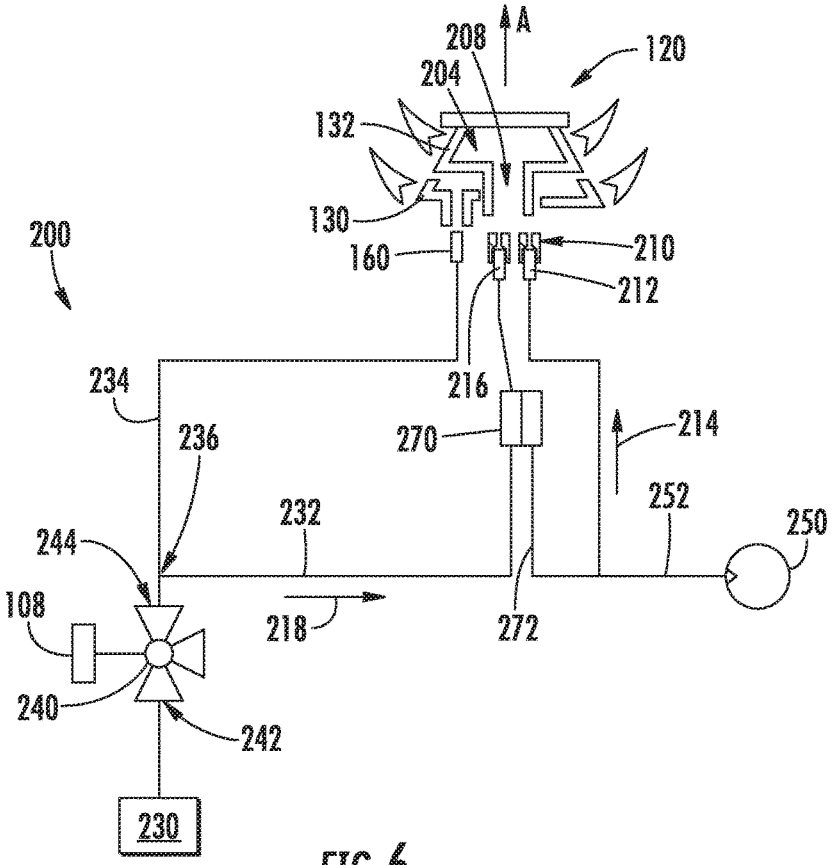
FIG. 6 provides a schematic view of a fuel supply system for providing a flow of fuel to a gas burner assembly according to an example embodiment of the present subject matter.
Figure 7:
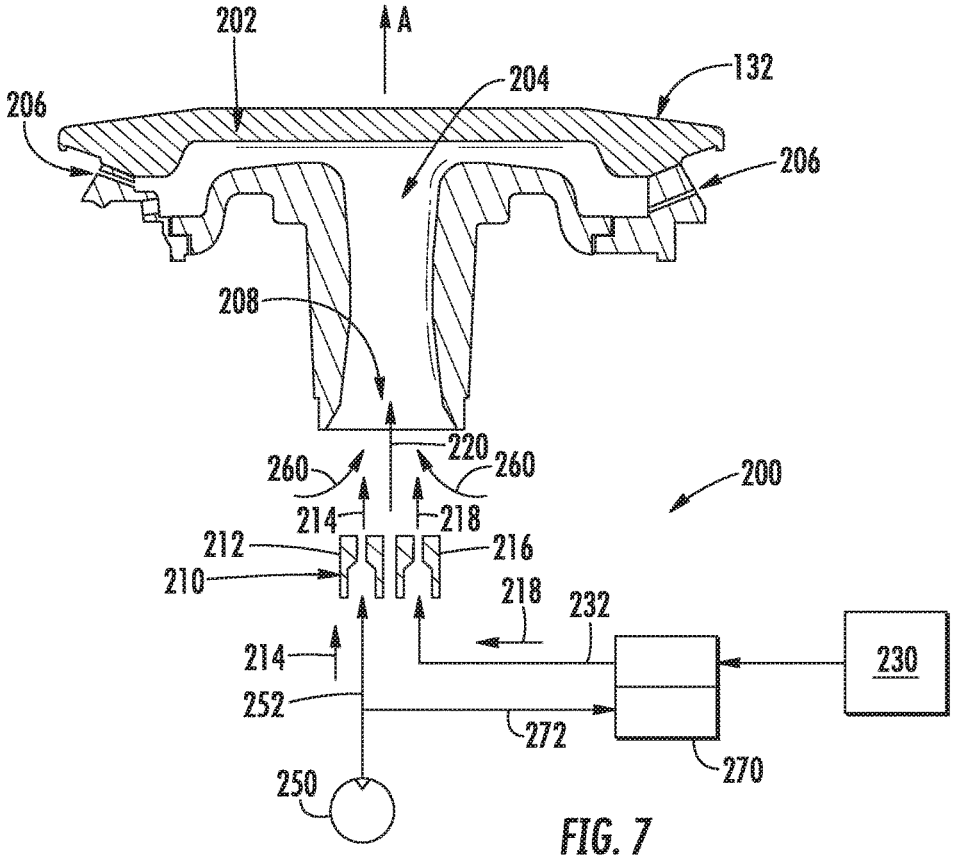
FIG. 7 provides another schematic view of the exemplary fuel supply system and gas burner assembly of FIG. 6 according to an example embodiment of the present subject matter.

Referring now to FIGS. 6 and 7, schematic views of gas burner assembly 120 and a fuel supply system 200 will be described according to an exemplary embodiment. For the purpose of explanation, simplified renderings of gas burner assembly 120 are illustrated in FIGS. 6 and 7. For example, only first burner stage 130 and second burner stage 132 are illustrated in schematic form in FIG. 6. In addition, FIG. 7 illustrates only second burner stage 132 for purposes of illustration and simplified explanation. Similar reference numerals may be used to refer to the same or analogous features throughout the figures. In addition, although fuel supply system 200 is illustrated as being used with gas burner assembly 120, it should be appreciated that fuel supply system 200 as described herein may be used in any suitable gas burner assembly and in any suitable cooktop appliance.

In general, fuel supply system 200 is configured for selectively supplying gaseous fuel such as propane or natural gas to first burner stage 130 and second burner stage 132 to regulate the amount of heat generated by the respective stages. In particular, fuel supply system 200 regulates the output of both first and second burner stages 130, 132 depending upon the desired output of gas burner assembly 120 selected by a user of gas burner assembly 120, e.g., using control knob 108. Thus, first burner stage 130 is separate or independent from second burner stage 132, e.g., such that first burner stage 130 is not in fluid communication with second burner stage 132 within gas burner assembly 120. In such manner, gaseous fuel within gas burner assembly 120 does not flow between first and second burner stages 130, 132.

As illustrated, gas burner assembly 120 may include a burner body 202 (such as burner bodies 122) which generally defines a fuel chamber 204 (such as, for example, fuel chambers 142 or 146) and a plurality of flame ports 206 (such as, for example, plurality of flame ports 140 or 144). In addition, burner body 202 also defines an inlet 208 through which the mixture of fuel and air may flow into fuel chamber 204 for combustion at flame ports 206.

Referring still to FIGS. 6 and 7, fuel supply system 200 includes an injection assembly 210 positioned proximate inlet 208 of fuel chamber 204. Injection assembly 210 (which may be the same as or similar to injection assembly 164) is used herein generally to refer to any device for injecting a stream of fuel and/or air into fuel chamber 104. For example, according to the illustrated embodiment, injection assembly 210 includes an air discharge orifice 212 that is positioned proximate inlet 208 of fuel chamber 204 for receiving a flow of combustion air (indicated by reference numeral 214) and directing the flow of combustion air 214 through inlet 208 into fuel chamber 204. Similarly, injection assembly 210 includes a fuel discharge orifice 216 that is positioned proximate inlet 208 of fuel chamber 204 for receiving a flow of fuel (indicated by reference numeral 218) and directing the flow of fuel 218 through inlet 208 into fuel chamber 204. In general, the flow of combustion air 214 and the flow of fuel 218 mix together to form a flow of aerated fuel 220 (FIG. 7) within fuel chamber 204 for combustion.

As best illustrated in FIGS. 3 through 7, air discharge orifice 212 and fuel discharge orifice 216 of injection assembly 210 are separate nozzles or injection ports that are positioned adjacent each other and are oriented along an axial direction A below inlet 208 of fuel chamber 204. In this manner, injection assembly 210 is configured for directing the flow of combustion air 214 and the flow of fuel 218 directly into fuel chamber 204 where the flows may be further mixed prior to combustion. However, it should be appreciated that according to alternative embodiments, injection assembly 210 could be a single nozzle for injecting the two flows 214, 218 through the same orifice, may have a dedicated mixing chamber to facilitate mixing prior to injection, or may have any other suitable, size, configuration, or orientation.

According to exemplary embodiments, any suitable sources of fuel and air may be coupled injection assembly 210 for providing the flow of combustion air 214 and/or the flow of fuel 218. Examples of such fuel and air supplies are described below, but this description is not intended to limit the scope of the present subject matter.

According to the illustrated embodiment of FIGS. 6 and 7, fuel supply system 200 may include a single fuel supply 230, such as a natural gas supply line or a propane tank. Gaseous fuel (e.g., natural gas or propane) is flowable from the pressurized fuel supply 230 into a fuel supply conduit 232 which is fluidly coupled to fuel supply 230 for providing the flow of fuel 218. As illustrated, a secondary fuel supply conduit 234 may be split off of fuel supply conduit 232 at a junction 236, e.g., via a plumbing tee, wye, or any other suitable splitting device. As illustrated in FIG. 6, according to an exemplary embodiment, secondary fuel supply conduit 234 may provide fuel for supporting operation of first burner stage 130.

Referring again to FIG. 6, fuel supply system 200 further includes a control valve 240 operably coupled to fuel supply conduit 232 for selectively directing a metered amount of fuel to gas burner assembly 120. More specifically, control valve 240 includes a valve inlet 242 fluidly coupled with fuel supply 230 and a valve outlet 244 fluidly coupled with fuel supply conduit 232 for supplying gaseous fuel to injection assembly 210, or more specifically, to fuel discharge orifice 216. According to the exemplary embodiment, control valve 240 is operably coupled with control knob 108. In this manner, a user of gas burner assembly 120 may control the flow of fuel 218 passing through fuel supply conduit 232.

Referring again to FIGS. 6 and 7, fuel supply system 200 includes a forced air supply 250 which is generally configured for providing the flow of combustion air 214 to injection assembly 210 for use as primary combustion air. In this regard, for example, fuel supply system 200 includes an air supply conduit 252 that provides fluid communication between forced air supply 250 and injection assembly 210, or more specifically, air discharge orifice 212. According to an exemplary embodiment, forced air supply 250 may be located remotely from gas burner assembly 120, such as proximate control panel 106 of cooktop appliance 100, and may be operably coupled with injection assembly 210 through air supply conduit 252.

According to the illustrated embodiment, forced air supply 250 is a fan or an air pump, such as an axial or centrifugal fan. However, it should be appreciated that forced air supply 250 may be any other device suitable for urging a flow of combustion air, such as an air compressor or a centralized compressed air system. Forced air supply 250 may be configured for supplying the flow of combustion air 214 at any suitable pressure above atmospheric pressure, such as two times, five times, or greater than ten times atmospheric pressure.

In addition, a source entrainment air 260 may be provided between injection assembly 210 and inlet 208 of fuel chamber 204 such that the flow of aerated fuel 220 may entrain additional air (as indicated by reference numeral 260 in FIG. 7) before entering inlet 208. For example according to the illustrated embodiment, the space between injection assembly 210 and inlet 208 is open to ambient air or otherwise in fluid communication with and air chamber or supply such that the flow of aerated fuel 220 may entrain additional air 260 as it enters inlet 208. The resulting flow of aerated fuel 220 may have an improved ratio of air for improved combustion generating a shorter, tighter, and more stable flame from flame ports 206.

Forced air supply 250 may be configured for operating whenever the flow of fuel 218 is detected or may be directly coupled to control knob 108 and may operate accordingly. Other types, positions, and configurations of forced air supply 250 are possible and within the scope of the present subject matter. Notably, by using forced air supply 250 to provide the flow of combustion air 214 not only increases primary combustion air, but also increases the entrainment of air (e.g., entrainment air 260) that is provided to fuel chamber 204. Thus, fuel supply system 200 can provide the flow of aerated fuel 220 into gas burner assembly 120 at a higher air-to-fuel ratio for improved combustion.

Notably, it may be desirable to regulate the flow of fuel 218 in the event of a failure of forced air supply 250, e.g., to prevent the flow of a fuel-rich mixture into fuel chamber 204. In this regard, for example, if forced air supply 250 fails to provide the flow of combustion air 214 for any reason, e.g., a fan failure, the flow of aerated fuel 220 into fuel chamber will rely solely on the entrainment air 260 and may result in a fuel-rich mixture. The fuel-rich mixture may generate a significant amount of carbon monoxide when combusted, and the potential for carbon monoxide exposure in such systems often necessitates the use of complicated sensors, flow sensing schemes, or other failure detection mechanisms for ensuring safe operation.

Therefore, according to the illustrated embodiment, fuel supply system 200 further includes a shutoff valve 270 which is generally configured for shutting down or reducing the flow of fuel 218 in the event of a failure of forced air supply 250. In this regard, for example, shutoff valve 270 may be operably coupled to fuel supply conduit 232 for regulating the flow of fuel 218 and fluidly coupled to forced air supply 250 through an air detection conduit 272 for sensing a pressure, flow rate, or other suitable parameter of the flow of combustion air 214.

Shutoff valve 270 may be any suitable type of valve that senses the flow of combustion air 214 and may regulate the flow of fuel 218. For example, according to the illustrated embodiment, shutoff valve 270 is a pressure controlled valve that is operably coupled with fuel supply 230 and forced air supply 250, and is configured for stopping the flow of fuel 218 when a pressure of the flow of combustion air 214 drops below a predetermined pressure. The predetermined pressure may be selected by a user, may be associated with a specific condition or event, may be selected to correspond to an operating condition of fuel supply system 200, or may be determined in any other suitable manner.

According to an exemplary embodiment, the predetermined pressure is a minimum combustion air threshold pressure, i.e., the pressure generated by a properly operating forced air supply 250 for generating a flow of combustion air 214 for desired combustion. In other words, if forced air supply 250 fails to provide a flow of combustion air 214 suitable to support operation of gas burner assembly 120, shutoff valve 270 may sense the low pressure associated with the flow of combustion air 214 and stop the flow of fuel 218. For example, the predetermined pressure may be any suitable pressure above atmospheric pressure, such as two times, five times, or greater than ten times atmospheric pressure.

Notably, fuel supply system 200 described above may provide several additional advantages relative to conventional fuel supply systems for a gas burner assembly, such as gas burner assembly 120. For example, forced air supply 250 may provide primary combustion air and increase the entrainment of additional air for improved combustion. In addition, shutoff valve 270 may be used to ensure safe operation of gas burner assembly 120, e.g., by stopping the flow of fuel 218 in the event the flow of combustion air 214 drops below some predetermined suitable level. Other benefits and advantages of the present subject matter will be apparent to those skilled in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:
- a top panel;
- a gas burner assembly positioned at the top panel, the gas burner assembly comprising a burner body defining a fuel chamber and a plurality of flame ports, the fuel chamber being in fluid communication with the plurality of flame ports; and
- a fuel supply system comprising:
  - a fuel supply for providing a flow of fuel through a fuel supply conduit;
  - a forced air supply for providing a flow of combustion air through an air supply conduit;
  - an injection assembly positioned proximate an inlet of the fuel chamber, the injection assembly being in fluid communication with the fuel supply conduit for receiving the flow of fuel and the air supply conduit for receiving the flow of combustion air; and
  - a pressure controlled valve operably coupled with the fuel supply and the forced air supply, the pressure controlled valve configured for stopping the flow of fuel when a pressure of the flow of combustion air drops below a predetermined pressure independent of a fuel pressure of the flow of fuel.

2. The cooktop appliance of claim 1, wherein the forced air supply is an air pump or an air compressor.

3. The cooktop appliance of claim 1, wherein the forced air supply is located remotely from the gas burner assembly or proximate a control panel of the cooktop appliance.

4. The cooktop appliance of claim 1, wherein the predetermined pressure is less than a minimum combustion air threshold pressure.

5. The cooktop appliance of claim 1, wherein the predetermined pressure is substantially equal to an atmospheric pressure.

6. The cooktop appliance of claim 1, wherein the injection assembly comprises:
- an air discharge orifice positioned proximate the inlet of the fuel chamber for directing the flow of combustion air into the fuel chamber; and
- a fuel discharge orifice positioned proximate the inlet of the fuel chamber for directing the flow of fuel into the fuel chamber.

7. The cooktop appliance of claim 6, wherein the fuel discharge orifice and the air discharge orifice are positioned adjacent each other and are oriented along a vertical direction below the inlet of the fuel chamber.

8. The cooktop appliance of claim 1, comprising:
- a control valve comprising a valve inlet in fluid communication with the fuel supply and a valve outlet in fluid communication with the fuel supply conduit, the control valve being configured for regulating the flow of fuel to the fuel supply conduit.

9. The cooktop appliance of claim 8, comprising a control knob operably coupled to the control valve and being rotatable for controlling the position of the control valve.

10. The cooktop appliance of claim 1, wherein a source of entrainment air is positioned between the fuel discharge orifice and the inlet of the fuel chamber such that the flow of fuel entrains additional air before entering the inlet of the fuel chamber.

11. The cooktop appliance of claim 1, wherein the fuel chamber is a first fuel chamber and the plurality of flame ports is a first plurality of flame ports, the burner body of the gas burner assembly further defining:
- a second fuel chamber in fluid communication with the fuel supply; and
- a second plurality of flame ports, the second fuel chamber being in fluid communication with the second plurality of flame ports.

12. The cooktop appliance of claim 11, wherein the first plurality of flame ports is positioned concentric with and below the second plurality of flame ports.

13. A fuel supply system for a gas burner assembly, the gas burner assembly comprising a burner body defining a fuel chamber having an inlet, the fuel supply system comprising:
- a fuel supply for providing a flow of fuel through a fuel supply conduit;
- a forced air supply for providing a flow of combustion air through an air supply conduit;
- an injection assembly positioned proximate the inlet of the fuel chamber, the injection assembly being in fluid communication with the fuel supply conduit for receiving the flow of fuel and the air supply conduit for receiving the flow of combustion air; and
- a pressure controlled valve operably coupled with the fuel supply and the forced air supply, the pressure controlled valve configured for stopping the flow of fuel when a pressure of the flow of combustion air drops below a predetermined pressure independent of a fuel pressure of the flow of fuel.

14. The fuel supply system of claim 13, wherein the forced air supply is an air pump or an air compressor.

15. The fuel supply system of claim 13, wherein the forced air supply is located remotely from the gas burner assembly or proximate a control panel of a cooktop appliance.

16. The fuel supply system of claim 13, wherein the predetermined pressure is less than a minimum combustion air threshold pressure.

17. The fuel supply system of claim 13, wherein the predetermined pressure is substantially equal to an atmospheric pressure.

18. The fuel supply system of claim 13, wherein the injection assembly comprises:

an air discharge orifice positioned proximate the inlet of the fuel chamber for directing the flow of combustion air into the fuel chamber; and a fuel discharge orifice positioned proximate the inlet of the fuel chamber for directing the flow of fuel into the fuel chamber.

19. The fuel supply system of claim 18, wherein the fuel discharge orifice and the air discharge orifice are positioned adjacent each other and are oriented along a vertical direction below the inlet of the fuel chamber.

20. The fuel supply system of claim 13, wherein a source of entrainment air is positioned between the fuel discharge orifice and the inlet of the fuel chamber such that the flow of fuel entrains additional air before entering the inlet of the fuel chamber.

* * * * *